US006860724B2

(12) United States Patent
Cho et al.

(10) Patent No.: US 6,860,724 B2
(45) Date of Patent: Mar. 1, 2005

(54) ROTARY COMPRESSOR

(75) Inventors: Sung-Hea Cho, Suwon (KR); Sung-Yeon Park, Yongin (KR); Chang-Ho Jung, Suwon (KR); Jong-Goo Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 85 days.

(21) Appl. No.: 10/352,000

(22) Filed: Jan. 28, 2003

(65) Prior Publication Data

US 2004/0071560 A1 Apr. 15, 2004

(30) Foreign Application Priority Data

Oct. 9, 2002 (KR) ..... 2002-61462

(51) Int. Cl.[7] ..... F04B 49/00

(52) U.S. Cl. ..... 417/218; 417/223; 417/326; 418/29

(58) Field of Search ..... 417/218, 221, 417/223, 326; 418/29

(56) References Cited

U.S. PATENT DOCUMENTS 4,236,874 A 12/1980 Sisk
5,522,235 A * 6/1996 Matsuoka et al. ..... 62/324.6
5,951,261 A * 9/1999 Paczuski ..... 417/315
6,092,993 A * 7/2000 Young et al. ..... 417/53
6,132,177 A 10/2000 Loprete et al.
6,190,137 B1 * 2/2001 Robbins et al. ..... 417/221
6,796,773 B1 * 9/2004 Choi et al. ..... 417/218

* cited by examiner

*Primary Examiner*—Charles G. Freay
(74) *Attorney, Agent, or Firm*—Staas & Halsey LLP

(57) ABSTRACT

A rotary compressor having a plurality of compression chambers and adapted to vary a compression capacity according to a direction of rotation of roller pistons within the compression chambers. A rotating shaft provided with a plurality of eccentric parts drives the roller pistons to compress refrigerant in the compression chambers by eccentric rotations of the eccentric parts. A reversible motor selectively rotates the rotating shaft in opposite directions, and a clutch engages the roller pistons such that the roller pistons perform a compressing action or an idle action according to a rotating direction of the rotating shaft, thus varying the compression capacity of the compressor according to a rotating direction of the rotating shaft. Thus, the compression capacity may be varied without using an inverter circuit.

59 Claims, 26 Drawing Sheets

ROTARY COMPRESSOR

CROSS-REFERENCE TO RELATED APPLICATION

This application claims the benefit of Korean Application No. 2002-61462, filed Oct. 9, 2002, in the Korean Intellectual Property Office, the disclosure of which is incorporated herein by reference.

BACKGROUND OF THE INVENTION

1. Field of the Invention

The present invention relates, in general, to a rotary compressor having a plurality of cylinders and, more particularly, to a rotary compressor which varies a compression capacity as desired, by selectively engaging one or a plurality of roller pistons according to a direction of rotation of a rotating shaft which drives the rotating pistons.

2. Description of the Related Art

As is well known to those skilled in the art, compressors are widely used in a variety of refrigeration systems, such as refrigerators and air conditioners. In such refrigeration systems, the compressor compresses refrigerant to highly pressurize the refrigerant prior to discharging the high-temperature and high-pressure refrigerant to a condenser. The compressors are typically classified into linear compressors, reciprocating compressors and rotary compressors. The present invention relates to a rotary compressor compressing a refrigerant by a roller piston which is arranged in a cylinder and is eccentrically rotated. More particularly, the present invention relates to a rotary compressor which is provided with a plurality of cylinders and which varies a capacity of the rotary compressor.

A conventional rotary compressor of a double cylinder structure will be now be described. Referring now to FIG. 1, a conventional rotary compressor includes a hermetic casing 100, with a drive unit 10 and a compressing unit 11 installed in the casing 100. A rotating shaft 101 is arranged at a center of the drive unit 10, and is provided with first and second eccentric parts 101*a* and 101*b*. A cylindrical rotor 102 surrounds the rotating shaft 101 and is rotated by an electromagnetic force. A cylindrical stator 103 surrounds the rotor 102 at a position which is spaced apart from the rotor 102 by a predetermined interval, and is fixedly mounted to the casing 100, with a coil wound around the stator 103. Further, a weight balancer 104 is provided at the bottom of the rotor 102 so as to reduce vibration and noise of the compressor due to an imbalance of the center of the rotation of the eccentric parts 101*a* and 101*b*. The compressing unit 11 includes the first and second eccentric parts 101*a* and 101*b* of the rotating shaft 101, and first and second cylinders 106*a* and 106*b* in which first and second roller pistons 105*a* and 105*b* are arranged. The upper surface of the first cylinder 106*a* is hermetically closed by an upper flange 107 which supports the rotating shaft 101, while the lower surface of the first cylinder 106*a* is closed by a middle plate 108. In this case, the middle plate 108 is positioned between the first and second cylinders 106*a* and 106*b* to hermetically separate a compression chamber 201*a* of the first cylinder 106*a* from a compression chamber 201*b* of the second cylinder 106*b*. Similarly, the lower surface of the second cylinder 106*b* is hermetically closed by a lower flange 109 which supports the rotating shaft 101, while the upper surface of the second cylinder 106*b* is closed by the middle plate 108. In such a rotary compressor having a double cylinder structure, after a refrigerant is compressed in the compressing unit 11 by a rotating force of the drive unit 10, the compressed refrigerant is discharged to the outside of the cylinder 106. Next, the refrigerant is discharged to the outside of the compressor through a refrigerant outlet pipe 110, and then flows into a condenser (not shown). In FIG. 1, the reference numeral 111 denotes an oil container for containing oil therein. Several components of the compressor are smoothly operated due to the lubricating effect of the oil.

The operation of the rotary compressor having a double cylinder structure will be described with reference to FIG. 2, which is a sectional view of one of the first and second cylinders 106*a* or 106*b* included in the compressor.

When the rotating shaft 101 is rotated in a direction as shown by an arrow in FIG. 2, the roller piston 105 is eccentrically rotated while being in contact with an inner circumferential surface of the cylinder 106, by the rotation of the eccentric part 101*a* or 101*b*, provided on the rotating shaft 101. During the rotation, a space distribution within a compression chamber 201, which comprises an intake part 21*a* and a discharge part 21*b*, is varied. That is, the intake part 21*a* becomes large in volume while becoming low in pressure, so refrigerant of an accumulator 112 is sucked into the intake part 21*a* through an intake hole 202. As the volume of the discharge part 21*b* becomes small due to the rotation of the roller piston 105, the refrigerant in the discharge part 21*b* is highly pressurized. Thus, the highly pressurized refrigerant is discharged to the outside of the cylinder 106 through an outlet hole 203. Thereafter, the refrigerant is discharged to the outside of the compressor through the refrigerant outlet pipe 110. The intake part 21*a* and the discharge part 21*b* are hermetically separated from each other by a vane 204 which is biased by a spring 204*a*, thus preventing the refrigerant from flowing between the intake part 21*a* and the discharge part 21*b*.

However, the conventional rotary compressor having the double cylinder structure has a problem that excessive vacuum may be generated in the discharge part 21*b* of the cylinder 106 when the rotating shaft 101 is rotated in a reverse direction, so the compressor may be broken. Thus, the conventional rotary compressor uses a motor which rotates the rotating shaft 101 in a single direction. Therefore, the first and second cylinders 106*a* and 106*b* and other associated components are constructed such that the refrigerant is compressed during a single directional rotation of the rotating shaft 101, so only a compressing action is ever performed in the first and second cylinders 106*a* and 106*b*. Thus, an expensive inverter circuit is required to vary a compression capacity of such a compressor. Moreover, a control board is additionally required to control the inverter circuit, thus undesirably increasing a production cost of the compressor and increasing power consumption when the compressor is operated.

A reciprocating compressor having a construction for varying a compression capacity is disclosed in U.S. Pat. No. 6,132,177. However, such a construction is applied to only a reciprocating compressor. Substantially, there has not been developed a rotary compressor having a construction for varying a compression capacity as desired. In addition, the design of a rotary compressor having a construction which varies a compression capacity has been recognized as being very difficult.

SUMMARY OF THE INVENTION

Accordingly, it is an aspect of the present invention to provide a rotary compressor with a plurality of cylinders, in which a compression capacity is variable as desired without using an inverter circuit or a control board for controlling the inverter circuit.

Additional aspects and advantages of the invention will be set forth in part in the description which follows and, in part, will be obvious from the description, or may be learned by practice of the invention.

The foregoing and/or other aspects of the present invention are achieved by providing a rotary compressor, comprising a plurality of cylinders, a rotating shaft provided with a plurality of eccentric parts which are eccentrically rotated in compression chambers defined in the cylinders, and a plurality of roller pistons which compress refrigerant in the compression chambers by eccentric rotations of the eccentric parts, the rotary compressor further comprising a reversible motor which rotates the rotating shaft in selectively opposite directions, and a clutch which engages the roller pistons such that the roller pistons perform a compressing action or an idle action according to the rotating direction of the rotating shaft, thus varying a compression capacity of the compressor according to the rotating direction of the rotating shaft.

BRIEF DESCRIPTION OF THE DRAWINGS

The above and/or other aspects and advantages of the invention will become apparent and more readily appreciated from the following description, taken in conjunction with the accompanying drawings of which.

DESCRIPTION OF THE PREFERRED EMBODIMENTS

Figure 1:
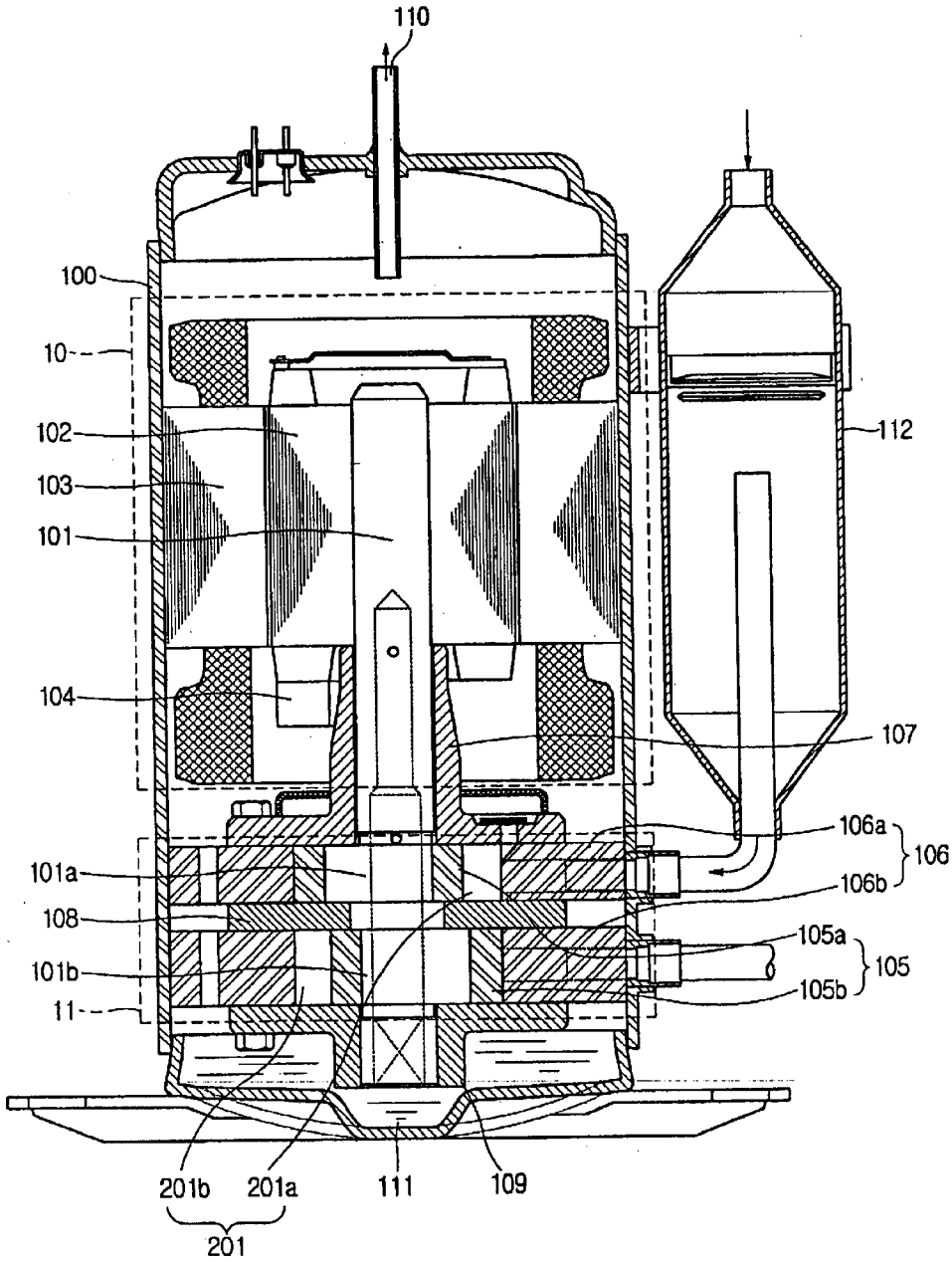
FIG. 1 (PRIOR ART)
FIG. 1 is a side sectional view showing a conventional rotary compressor.
Figure 2:
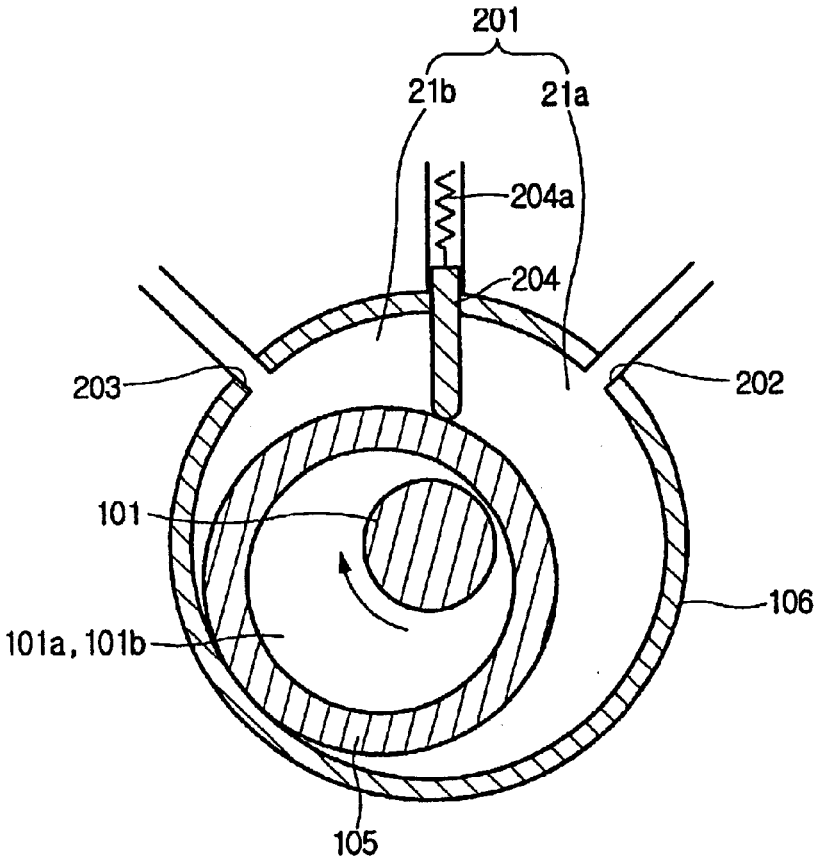
FIG. 2 (PRIOR ART)
FIG. 2 is a sectional view showing a compressing unit of the conventional rotary compressor shown in FIG. 1.

Reference will now be made in detail to the embodiments of the present invention, examples of which are illustrated in the accompanying drawings, wherein like reference numerals refer to like elements throughout.

Figure 3:
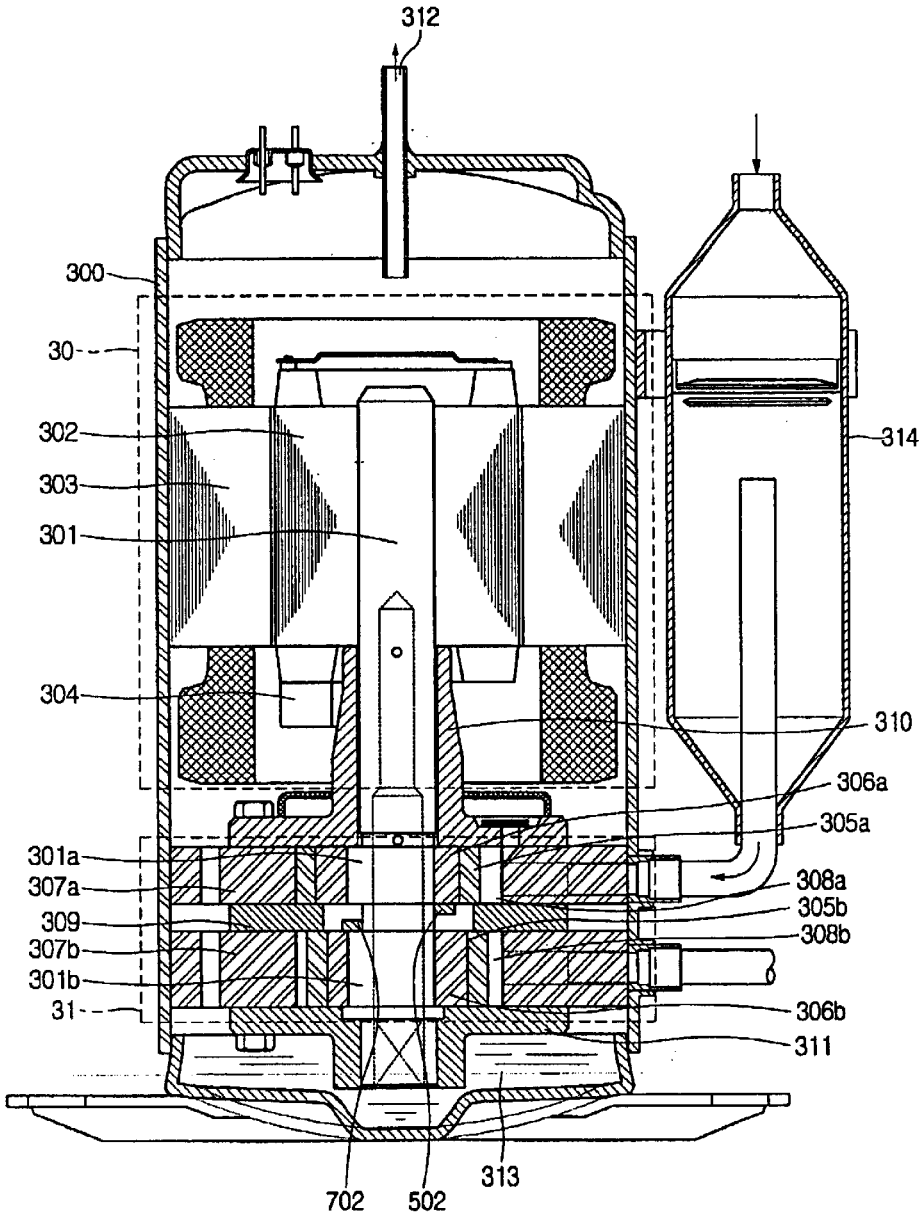
FIG. 3 is a side sectional view of a rotary compressor according to an embodiment of the present invention.

FIG. 3 is a side sectional view showing a rotary compressor according to an embodiment of the present invention. As shown in FIG. 3, the rotary compressor includes a hermetic casing 300 which defines an external envelope and an appearance of the compressor. A drive unit 30 and a compressing unit 31 are housed in the casing 300. A rotating shaft 301 is set at a center of the drive unit 30, and is provided with first and second eccentric parts 301*a* and 301*b*. A rotor 302 is mounted to the rotating shaft 301, and is rotated by an electromagnetic force generated by an interaction of a permanent magnet which is buried in or attached to the rotor 302 and an electromagnet formed in a stator 303. The stator 303 surrounds the rotor 302 at a position which is spaced apart from the rotor 302 by a predetermined interval, and is fixedly mounted to the casing 300, with a coil wound around the stator 303 for conducting an electrical current to generate the stator electromagnet. In the rotary compressor according to the present invention, a motor comprising the rotor 302 and the stator 303 is constructed as a reversible motor which rotates the rotating shaft 301 in selectively opposite directions. Further, a weight balancer 304 is mounted to the bottom of the rotor 302 so as to reduce the vibration and noise of the compressor due to an imbalance of the center of the rotation of the eccentric parts 301*a* and 301*b*.

The compressing unit 31 comprises first and second cylinders 307*a* and 307*b*. The first eccentric part 301*a* and a first roller piston 305*a* are provided in the first cylinder 307*a*, and the second eccentric part 301*b* and a second roller piston 305*b* are provided in the second cylinder 307*b*. Further, a first cam bushing 306*a* is provided between the first eccentric part 301*a* and the first roller piston 305*a*, and a second cam bushing 306*b* is provided between the second eccentric part 301*b* and the second roller piston 305*b*. The first cam bushing 306*a* makes the first roller piston 305*a* eccentrically rotate when the rotating shaft 301 rotates clockwise, thus performing a compressing action in the first cylinder 307*a*. When the rotating shaft 301 rotates counterclockwise, the first cam bushing 306*a* makes the first roller piston 305*a* idly rotate so that the compressing action is not performed in the first cylinder 307*a*. The second cam bushing 306*b* makes the second roller piston 305*b* idly rotate when the rotating shaft 301 rotates clockwise, so that the compressing action is not performed in the second cylinder 307*b* during the clockwise rotation. When the rotating shaft 301 rotates counterclockwise, the second cam bushing 306*b* makes the second roller piston 305*b* eccentrically rotate, thus performing a desired compressing action in the second cylinder 307*b*. An upper surface of the first cylinder 307*a* is hermetically closed by an upper flange 310 which supports the rotating shaft 301, and a lower surface of the first cylinder 307*a* is closed by a middle plate 309. The middle plate 309 is positioned between the first and second cylinders 307*a* and 307*b* to hermetically separate a compression chamber 308*a* of the first cylinder 307*a* from a compression chamber 308*b* of the second cylinder 307*b*. A lower surface of the second cylinder 307*b* is hermetically closed by a lower flange 311 which supports the rotating shaft 301, while the upper surface of the second cylinder 307*b* is closed by the middle plate 309.

Figure 4:
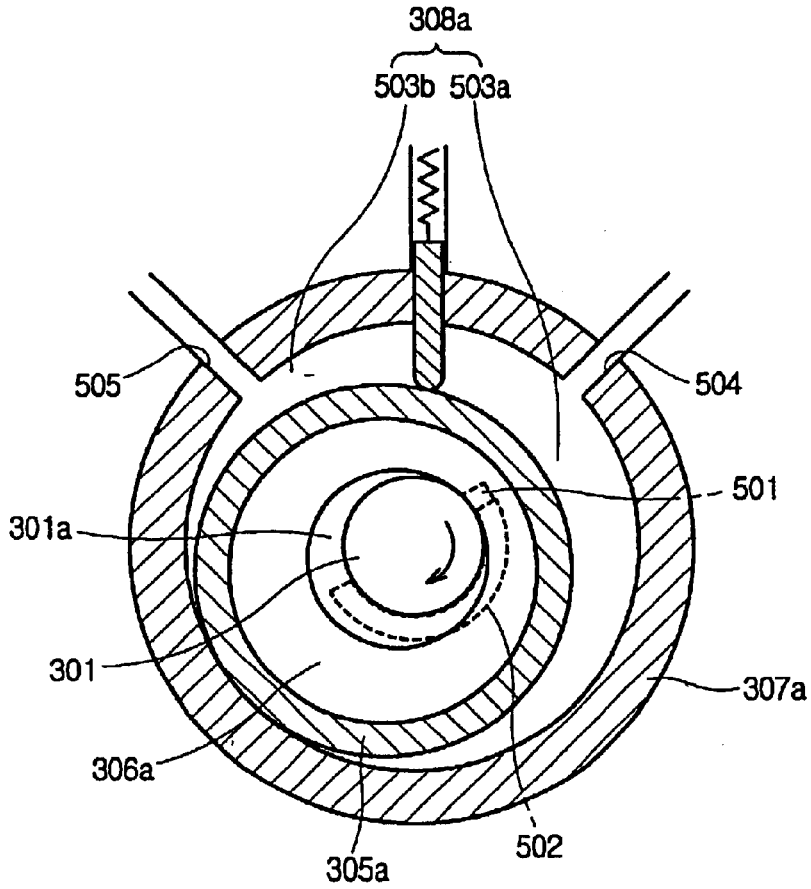
FIG. 4 is a sectional view of a compressing unit included in the rotary compressor shown in FIG. 3, showing a compression action in a first chamber with rotation in a clockwise direction.

In the rotary compressor shown in FIG. 4, a refrigerant is compressed in the compressing unit 31 by a rotating force of the drive unit 30. After compression, the compressed refrigerant is discharged to the outside of the cylinders 307*a* and 307*b*. Next, the refrigerant is discharged to the outside of the compressor through a refrigerant outlet pipe 312, and the refrigerant then flows into a condenser (not shown). In FIG. 3, reference numerals 502 and 702 denote first and second locking steps which will be described in detail below. Reference numeral 313 denotes an oil container for containing oil therein. Several components of the compressor are smoothly operated due to the lubricating effect of the oil.

The operation of the rotary compressor constructed as shown in FIG. 3 will be described in the following with reference to FIGS. 4 through 8.

FIG. 4 shows a compressing action performed in the first cylinder 307*a*. When an eccentric direction of the first eccentric part 301*a* is equal to an eccentric direction of the first cam bushing 306*a* during a clockwise rotation of the rotating shaft 301, the first roller piston 305*a* performs a compressing action in the first cylinder 307*a*. In order to make the eccentric direction of the first eccentric part 501 coincide with the eccentric direction of the first cam bushing 306*a*, a first stop pin 501 and a first locking step 502 are provided. The first stop pin 501 is provided on the rotating shaft 301 at a position under the first eccentric part 301*a* and perpendicular to the rotating shaft 301. The first locking step 502 is arc-shaped and projects downwardly from the lower surface of the first cam bushing 306*a* and stops the first stop pin 501. That is, when the first stop pin 501 rotating along with the rotating shaft 301 is rotated, the first locking step 502 stops the first stop pin 501 without allowing the stop pin 501 to further slidably rotate with respect to the first cam bushing 306*a*. According to the present invention, the first stop pin 501 is stopped at a first end of the first locking step 502 such that the first eccentric part 301*a* of the rotating shaft 301 and the first cam bushing 306*a* are rotated clockwise together. When the eccentric direction of the first eccentric part 301*a* is equal to the eccentric direction of the first cam bushing 306*a* during a clockwise rotation of the rotating shaft 301, a low-pressure refrigerant gas flows into an intake part 503*a* of the compression chamber 308*a* through an intake hole 504 from an accumulator 314. Meanwhile, in a discharging part 503*b* of the compression chamber 308*a*, a highly-pressurized refrigerant gas is discharged to the outside of the first cylinder 307*a* through an outlet hole 505.

Figure 5:
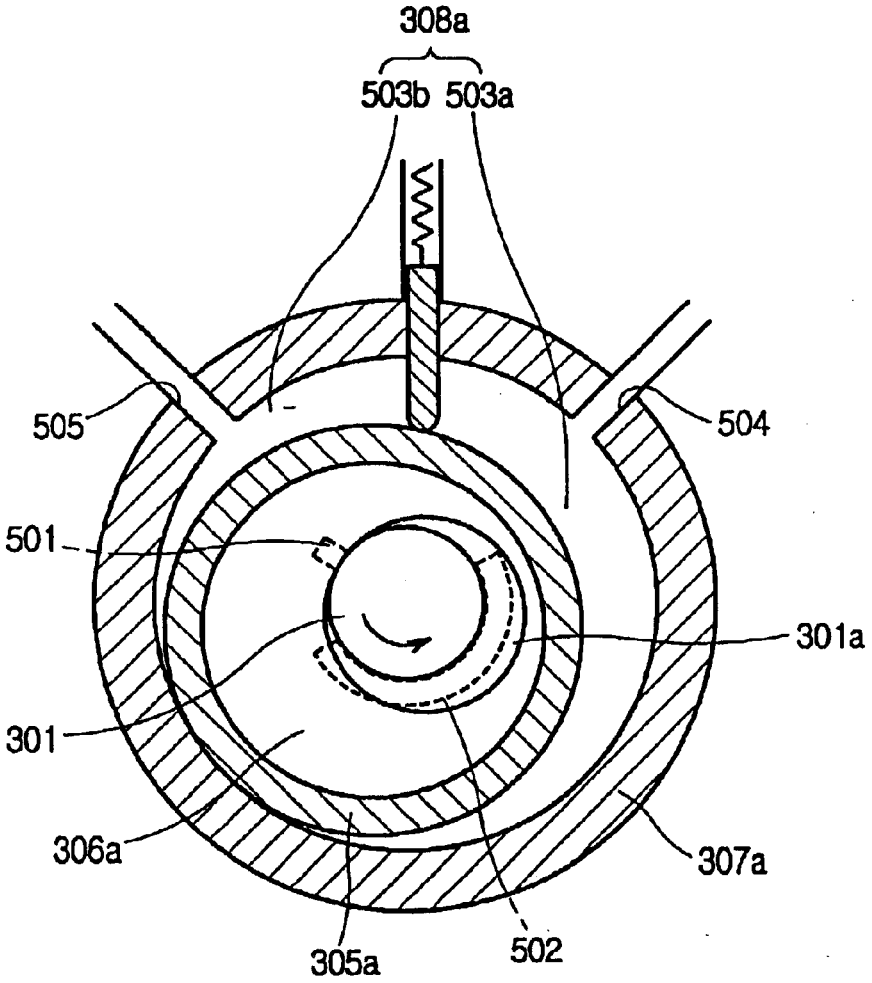
FIG. 5 is a sectional view of the compressing unit included in the rotary compressor shown in FIG. 3, showing a transition between a compression action and an idle action in the first chamber.
Figure 6:
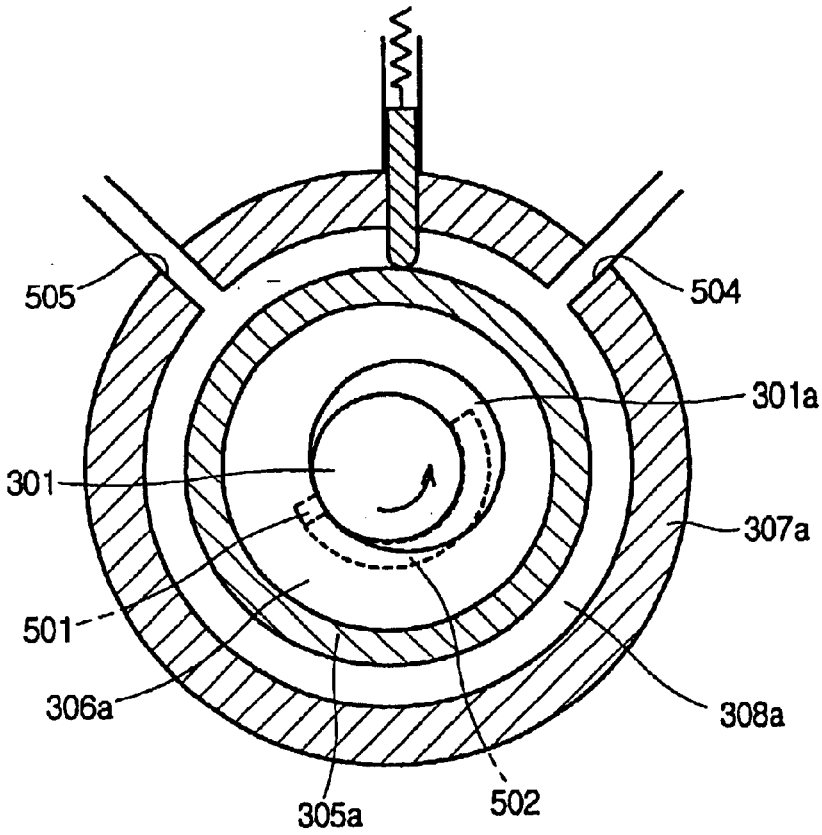
FIG. 6 is a sectional view of the compressing unit included in the rotary compressor shown in FIG. 3, showing an idle action in the first chamber.

An initial state of the first cylinder 307*a* when the rotating direction of the first eccentric part 301*a* is changed is shown in FIG. 5. In this case, the first eccentric part 301*a* is slidably rotated with respect to the first cam bushing 306*a* while the first cam bushing 306*a* and the first roller piston 305*a* are stopped. At this time, the first stop pin 501 rotates along with the rotating shaft 301 from the first end to the second end of the first locking step 502, as shown in FIG. 5. When the first eccentric part 301*a* is rotated counterclockwise by a predetermined angular distance as shown in FIG. 6, the first stop pin 501 is stopped at the second end of the locking step 502, so the eccentric direction of the first eccentric part 301*a* is opposite to the eccentric direction of the first cam bushing 306*a*. With the eccentric directions opposite, the center of gravity of the first roller piston 305*a* coincides with the center of rotation of the rotating shaft 301. Assuming that there is no frictional force between an inner surface of the roller piston 305*a* and an outer surface of the first cam bushing 306*a*, and the eccentricity of the first eccentric part 301*a* is equal to the eccentricity of the first cam bushing 306*a*, and the eccentric direction of the first eccentric part 301*a* is directly opposite to the eccentric direction of the first cam bushing 306*a*, the first roller piston 305*a* stops rotating in the first cylinder 307*a*. Of course, if such friction exists, the first roller piston 305*a* will rotate in a counterclockwise direction. In either the case where the first roller piston 305*a* is stopped or the case where the first roller piston is rotated counterclockwise by friction created between the first roller piston 305*a* and the first cam bushing 306*a*, the intake part 503*a* is integrated with the discharging part 503*b* into a single part, so the first roller piston 305*a* performs an idle action. Thus, the refrigerant is not compressed in the first cylinder 307*a*.

Figure 7:
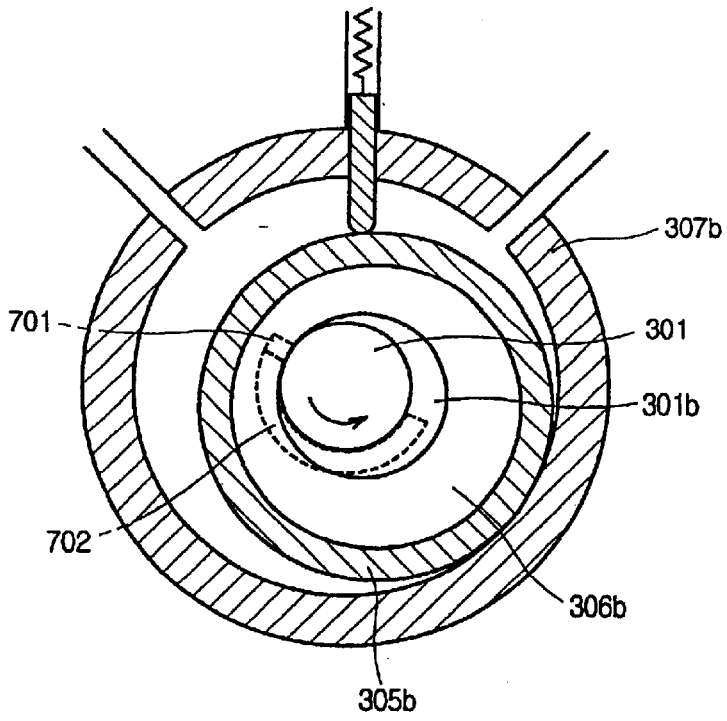
FIG. 7 is a sectional view of the compressing unit included in the rotary compressor shown in FIG. 3, showing a compression action in a second chamber.
Figure 8:
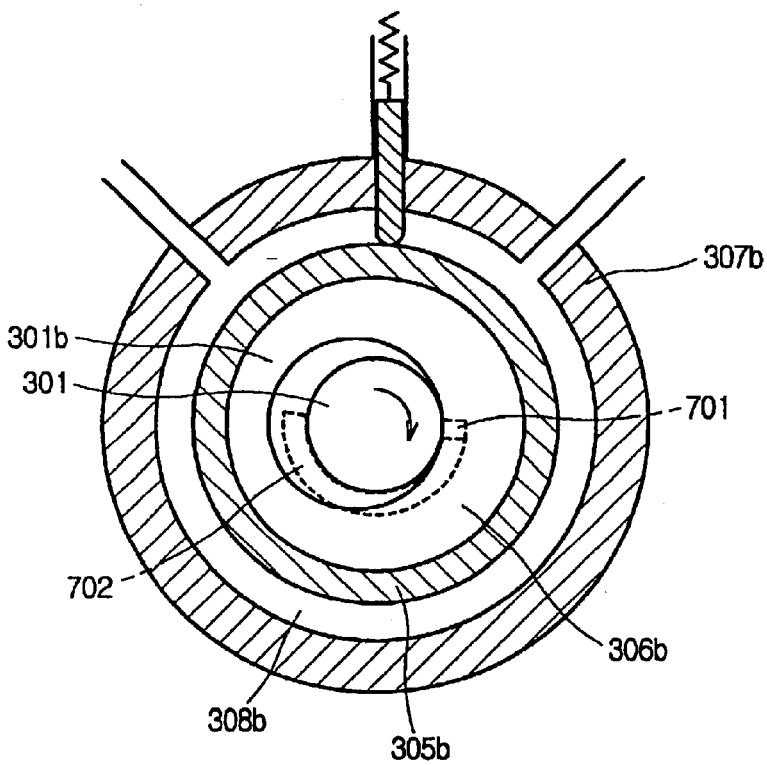
FIG. 8 is a sectional view of the compressing unit included in the rotary compressor shown in FIG. 3, showing an idle action in the second chamber.

Meanwhile, FIGS. 7 and 8 show a compressing action and an idle action performed in the second cylinder 307*b* by the second roller piston 305*b*, which is different from the compressing action and the idle action performed in the first cylinder 307*a* by the roller piston 305*a* as the rotating shaft 301 is rotated. That is, FIG. 7 shows a compressing action performed in the second cylinder 307*b* when the rotating shaft 301 is rotated counterclockwise, and FIG. 8 shows an idle action performed in the second cylinder 307*b* when the rotating shaft 301 is rotated clockwise. As shown in FIG. 7, an arc-shaped second locking step 702 is upwardly projected from an upper surface of the second cam bushing 306*b*. A second stop pin 701 is provided on the rotating shaft 301 at a position above the second eccentric part 301*b* and perpendicular to the rotating shaft 301, so the second stop pin 701 is slidably moved relative to the second cam bushing 306*b* when the rotating direction of the rotating shaft 301 is changed. The second stop pin 701 is stopped at a first or second end of the second locking step 702. Thus, the second stop pin 701, in cooperation with the second locking step 702, serves to control the eccentric directions of the second eccentric part 301*b* and the second cam bushing 306*b* according to the direction of rotation of the rotating shaft 301.

As described above with reference to FIGS. 4 through 8, when the rotating shaft 301 is rotated clockwise, a compressing action is performed in the first cylinder 307*a* arranged at an upper position while an idle action is performed in the second cylinder 307*b* arranged at a lower position. When the rotating shaft 301 is rotated counterclockwise, an idle action is performed in the first cylinder 307*a* while a compressing action is performed in the second cylinder 307*b*. The first and second stop pins 501 and 701 and the first and second locking steps 502 and 702 serve as an eccentric control unit which controls the eccentric directions of the first and second eccentric parts 301*a* and 301*b* and the first and second cam bushings 306*a* and 306*b* so that the first and second roller pistons 305*a* and 305*b* are eccentrically rotated or idly rotated according to a rotation direction of the shaft 301. The eccentric control unit and the first and second cam bushings 306*a* and 306*b* serve as a clutch which engages the first and second roller pistons 305*a* and 305*b* such that the pistons 305*a* and 305*b* perform a compressing action or an idle action. Further, the rotary compressor according to the present invention may be designed such that a ratio of a compression capacity obtained in the first cylinder 307*a* when the rotating shaft 301 is rotated clockwise to a compression capacity obtained in the second cylinder 307*b* when the rotating shaft 301 is rotated counterclockwise becomes 10:4. As a result, the compression capacity of the compressor is varied according to a rotating direction of the rotating shaft 301 which may be rotated in opposite directions by the reversible motor. Of course, according to the present invention, the compression capacity ratio of the first cylinder 307*a* to the second cylinder 307*b* may be differently arranged and the compression capacity is not limited to a ratio of 10:4. Furthermore, the compressor of the present invention may be designed such that the compression capacity of the first cylinder 307*a* is smaller than the compression capacity of the second cylinder 307*b*.

FIGS. 9 through 12 show rotating shafts 301 according to different embodiments of the present invention. Each of the rotating shafts 301 is provided with the first and second eccentric parts 301*a* and 301*b*. When the reversible motor is rotated, the rotating shaft 301 transmits a rotating force of the motor to the first and second roller pistons 305*a* and 305*b* which are provided in the first and second cylinders 307*a* and 307*b*, respectively.

Figure 9:
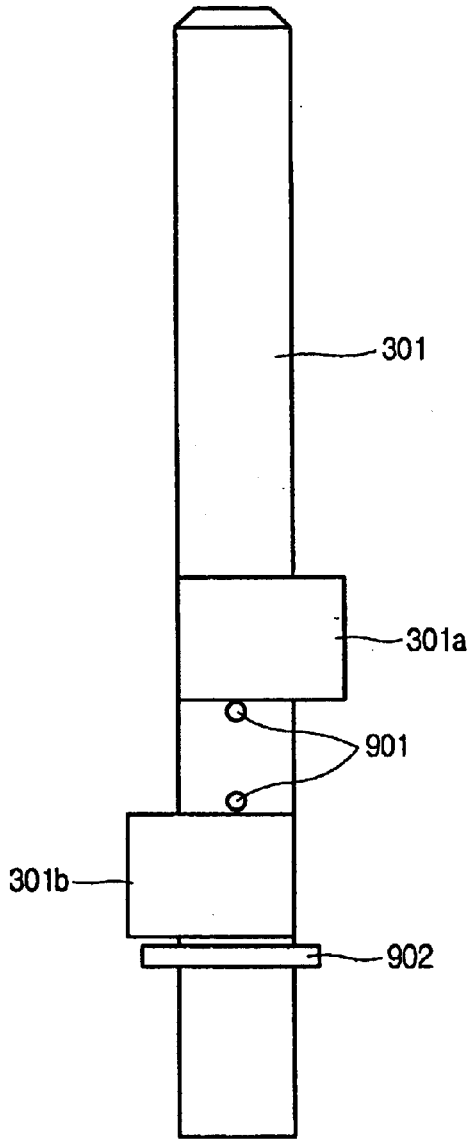
FIG. 9 is a side view of a first configuration of a rotating shaft of the rotary compressor according to the present invention.

In the rotating shaft 301 of FIG. 9, the first eccentric part 301*a* to be received in the first cylinder 307*a* is positioned above the second eccentric part 301*b* to be received in the second cylinder 307*b* in such a way that the eccentric direction of the first eccentric part 301*a* is opposite to the eccentric direction of the second eccentric part 301*b*, in the same manner as a rotating shaft used in a conventional rotary compressor. Two internally-threaded pin holes 901 are formed at predetermined positions between the first eccentric part 301*a* and the second eccentric part 301*b*. The stop pins 501 and 701 are formed as externally-threaded stop pins 501 and screwed into a respective one of the two pin holes 901. Further, a support step 902 is provided on the rotating shaft 301 at a predetermined position under the second eccentric part 301*b*, and supports the second cam bushing 306*b*. Such a support step 902 supports the second cam bushing 306*b* so as to prevent the second cam bushing 306*b* from being downwardly removed from the rotating shaft 301, and contacts the lower flange 311 which supports the rotating shaft 301 and hermetically covers the lower surface of the second cylinder 307*b*.

Figure 10:
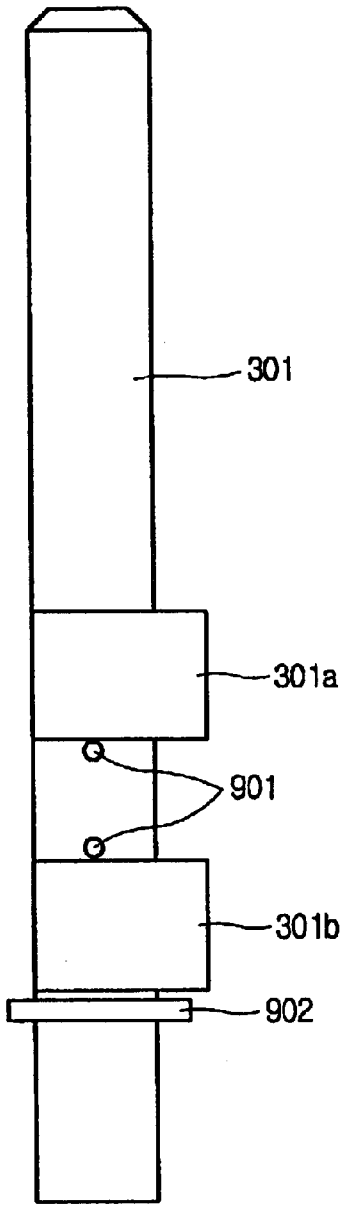
FIG. 10 is a side view of a second configuration of a rotating shaft of the rotary compressor according to the present invention.

In a rotating shaft 301 shown in FIG. 10, the first and second eccentric parts 301*a* and 301*b* are arranged with equal eccentric directions. The arrangement of FIG. 10 allows the construction of a weight balancer to be simple, like a weight balancer provided in a rotary compressor having a single eccentric part and a single cylinder. As described above, the weight balancer reduces the vibration and noise of the compressor caused by the first and second eccentric parts 301*a* and 301*b* when the rotating shaft 301 is rotated. Thus, in order to construct the weight balancer simply, the eccentric direction of the first eccentric part 301*a* may be equal to the eccentric direction of the second eccentric part 301*b* within ±30°. But, according to the present invention, the eccentric direction of the first eccentric part 301*a* is not necessarily equal to the eccentric direction of the second eccentric part 301*b*. Nor, is the eccentric direction of the first eccentric part 301*a* necessarily opposite to the eccentric direction of the second eccentric part 301*b*. That is, when the rotary compressor of the present invention is provided with an optimum weight balancer determined on the basis of an inertia moment and a centrifugal force of the rotating shaft 301, the eccentric directions of the first and second eccentric parts 301*a* and 301*b* are not important. As such, although the eccentric directions of the first and second eccentric parts 301*a* and 301*b* are not important, the eccentric control unit which determines the eccentric directions of the first and second eccentric parts 301*a* and 301*b* and the first and second cam bushings 306*a* and 306*b* must be carefully designed.

Figure 11:
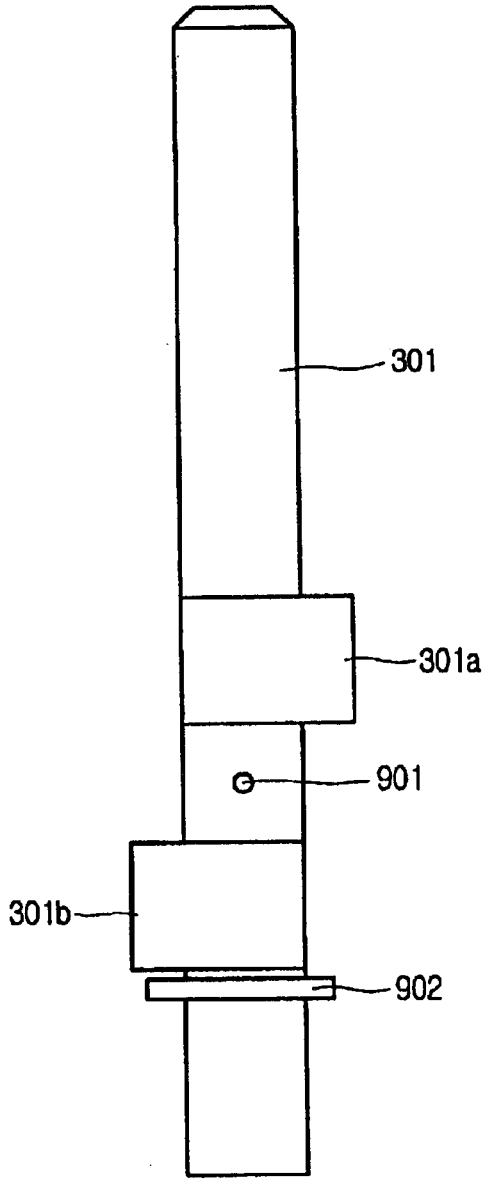
FIG. 11 is a side view of a third configuration of a rotating shaft of the rotary compressor according to the present invention.
Figure 12:
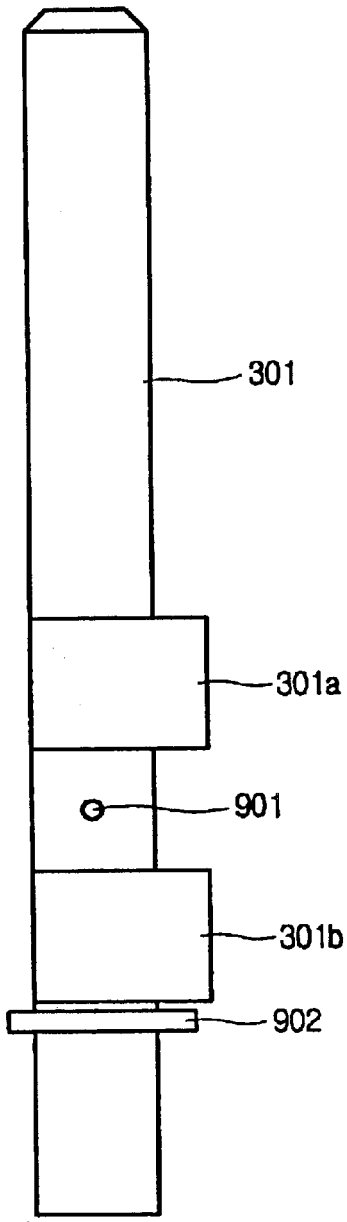
FIG. 12 is a side view of a fourth configuration of a rotating shaft of the rotary compressor according to the present invention.

FIGS. 11 and 12 show rotating shafts 301 each having a single pin hole 901 between the first and second eccentric parts 301*a* and 301*b*. The construction and operation of the rotating shafts 301 of FIGS. 9 through 12 with the first and second cam bushings 306*a* and 306*b* will be further described below.

Figure 13A:
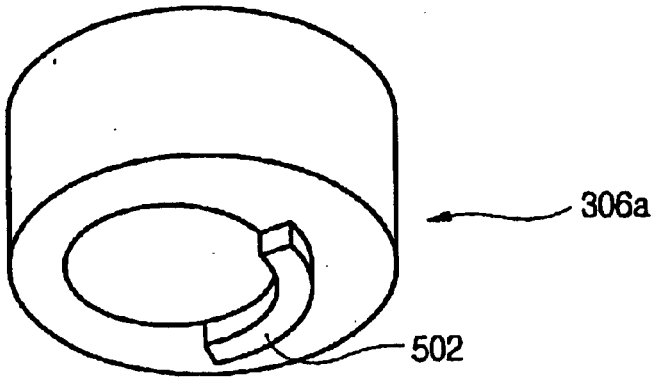
FIG. 13A is a perspective view showing a first cam bushing according to an embodiment of the present invention.
Figure 13B:
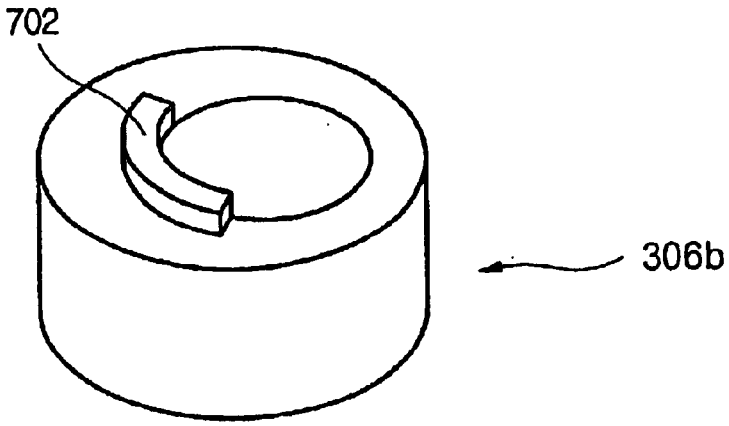
FIG. 13B is a perspective view showing a second cam bushing according to an embodiment of the present invention.

FIGS. 13A and 13B show first and second cam bushings 306*a* and 306*b* according to an embodiment of the present invention, with the first and second cam bushings 306*a* and 306*b* clutching the roller pistons 305*a* and 305*b* such that the roller pistons 305*a* and 305*b* perform a compressing action or an idle action according to a direction of rotation of the roller pistons 305*a* and 305*b*.

FIG. 13A shows the first cam bushing 306*a* which is provided between the first eccentric part 301*a* and the first roller piston 305*a* in the first cylinder 307*a*. FIG. 13B shows the second cam bushing 306*b* which is provided between the second eccentric part 301*b* and the second roller piston 305*b* in the second cylinder 307*b*. In order to easily assemble the compressor, the inner diameter of the first cam bushing 306*a* must be equal to or larger than the outer diameter of the first eccentric part 301*a* of the rotating shaft 301, while the inner diameter of the second cam bushing 306*b* must be equal to or larger than the outer diameter of the second eccentric part 301*b* of the rotating shaft 301. The arc-shaped first locking step 502 is provided on the lower surface of the first cam bushing 306*a* and the arc-shaped second locking step 702 is provided on the upper surface of the second cam bushing 306*b*. The first and second cam bushings 306*a* and 306*b* of FIGS. 13A and 13B may be applied to the rotating shafts 301 shown in FIGS. 9 and 10.

Figure 14:
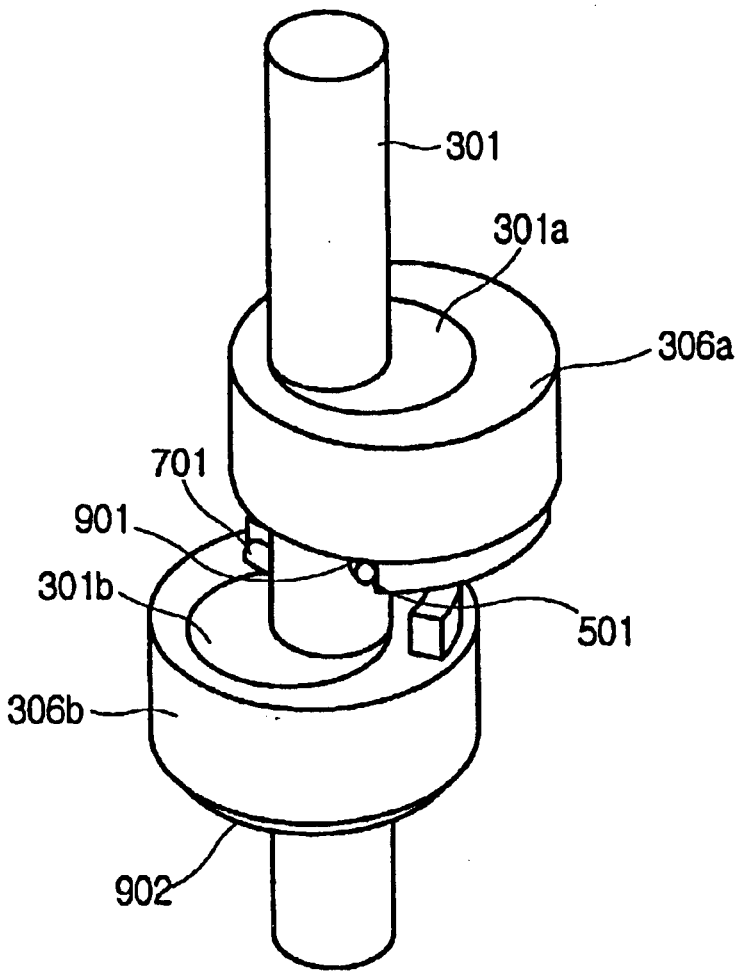
FIG. 14 is a perspective view showing the first and second cam bushings of FIGS. 13A and 13B assembled with a rotating shaft.

FIG. 14 shows the first and second cam bushings 306*a* and 306*b* of FIGS. 13A and 13B assembled with the rotating shaft 301 of FIG. 9. Of course, the first and second cam bushings 306*a* and 306*b* of FIGS. 13A and 13B may be applied to the rotating shaft 301 of FIG. 10 by changing the positions of the pin holes 901 and the first and second locking steps 502 and 702.

Figure 15A:
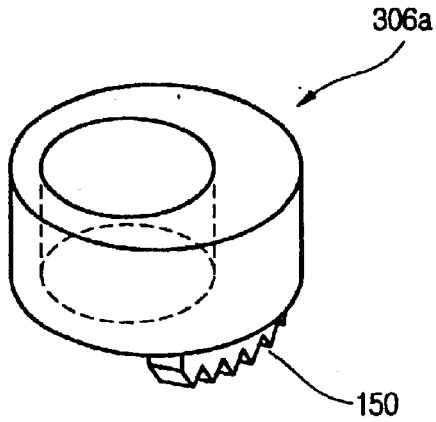
FIG. 15A is a perspective view showing a first cam bushing according to another embodiment of the present invention.
Figure 15B:
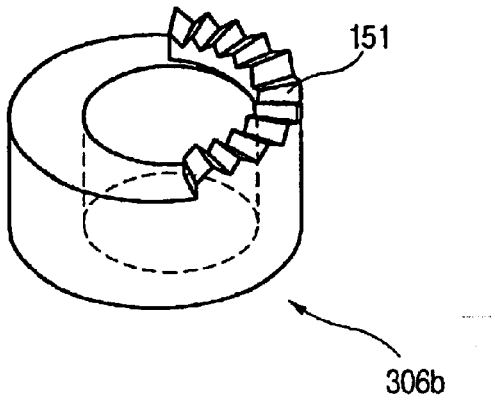
FIG. 15B is a perspective view showing a second cam bushing according to another embodiment of the present invention.

FIGS. 15A and 15B show first and second cam bushings 306*a* and 306*b* according to another embodiment of the present invention. In this case, the first cam bushing 306*a* is provided on a lower surface with an arc-shaped downward toothed part 150, and the second cam bushing 306*b* is provided on its upper surface with an arc-shaped upward toothed part 151. Such first and second cam bushings 306*a* and 306*b* may be applied to the rotating shafts 301 shown in FIGS. 11 and 12.

Figure 16:
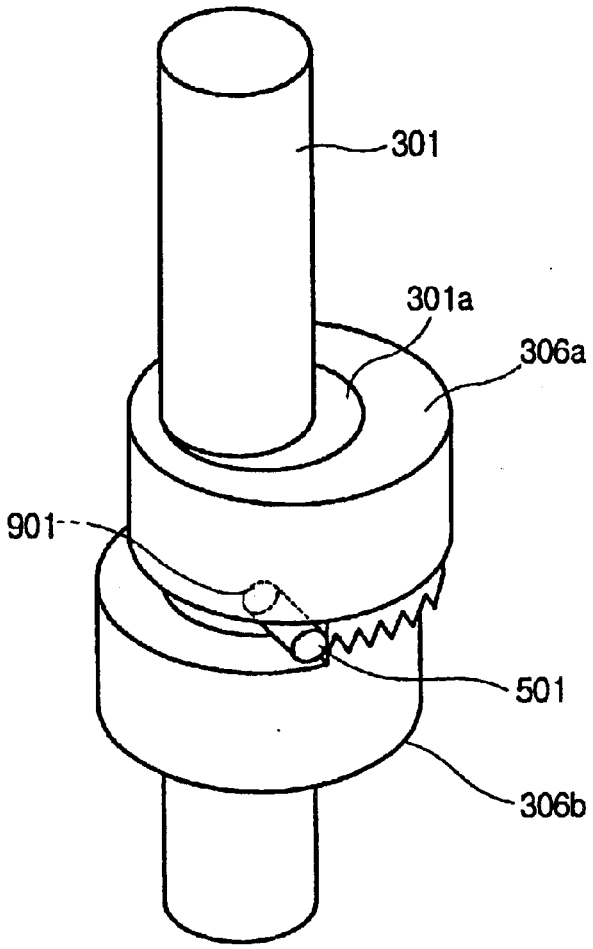
FIG. 16 is a perspective view showing the first and second cam bushings of FIGS. 15A and 15B assembled with a rotating shaft.

FIG. 16 shows the first and second cam bushings 306*a* and 306*b* of FIGS. 15A and 15B assembled with the rotating shaft 301 of FIG. 12. As shown in FIG. 16, when the first and second cam bushings 306*a* and 306*b* are assembled with the rotating shaft 301, the downward toothed part 150 of the first cam bushing 306*a* engages with the upward toothed part 151 of the second cam bushing 306*b*. The first and second cam bushings 306*a* and 306*b* are integrally rotated in opposite directions, through the engagement of the downward toothed part 150 with the upward toothed part 151. In this case, the stop pin 501 inserted into the pin hole 901 is stopped at either end of the toothed parts 150 and 151 which engage with each other, thus determining the eccentric directions of the first and second eccentric parts 301*a* and 301*b* and the eccentric directions of the first and second cam bushings 306*a* and 306*b* according to a rotating direction of the rotating shaft 301. As described above, the first and second cam bushings 306*a* and 306*b* of FIGS. 15A and 15B may be applied to the rotating shaft 301 of FIG. 11 by changing the positions of the pin hole 901 and the downward and upward toothed parts 150 and 151.

Figure 17:
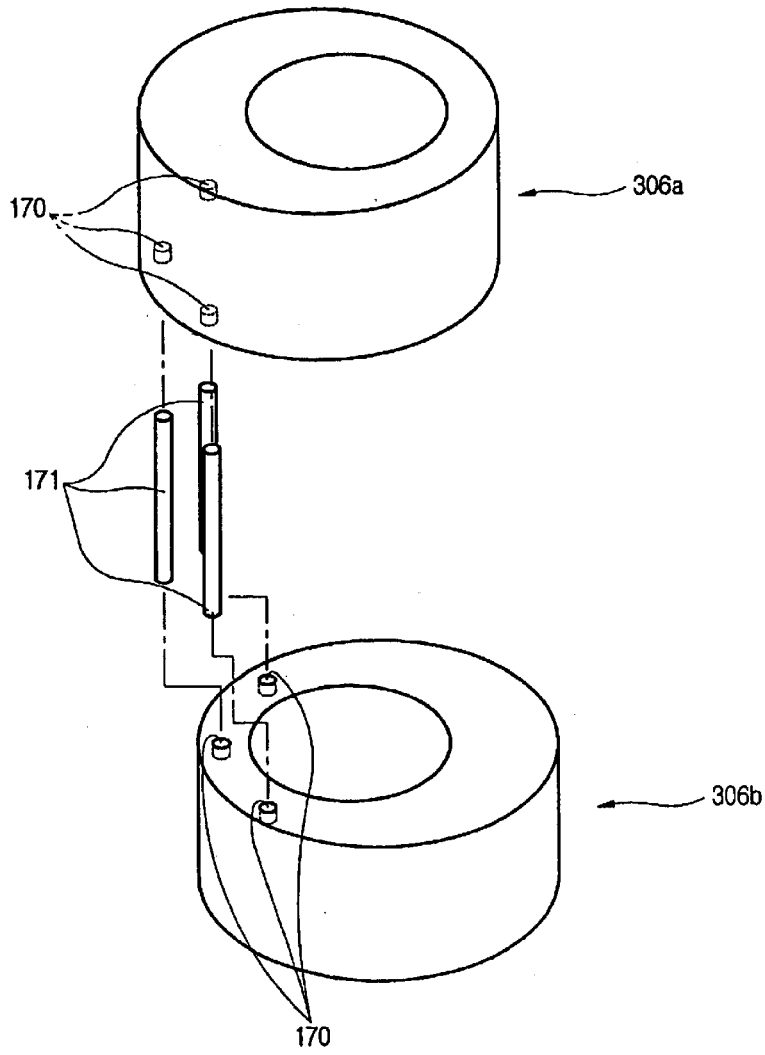
FIG. 17 is an exploded perspective view showing first and second cam bushings according to a further embodiment of the present invention.

FIG. 17 shows first and second cam bushings 306*a* and 306*b* according to a further embodiment of the present invention. In this case, the first and second cam bushings 306*a* and 306*b* are connected to each other by three rods 171 such that the first and second cam bushings 306*a* and 306*b* are integrally rotated. In order to connect the first and second cam bushings 306*a* and 306*b* to each other using a rod assembly having the three rods 171, three rod holes 170 are formed on the lower surface of the first cam bushing 306*a*, and three rod holes 170 are formed on the upper surface of the second cam bushing 306*b*. The first and second cam bushings 306*a* and 306*b* of FIG. 17 may be applied to the rotating shafts 301 shown in FIGS. 11 and 12. Since the method of assembling the first and second cam bushings 306*a* and 306*b* of FIG. 17 with the rotating shaft 301 is very similar to that of assembling the first and second cam bushings 306*a* and 306*b* shown in FIGS. 15A ad 15B with the rotating shaft 301, the method of assembling the first and second cam bushings 306*a* and 306*b* shown in FIG. 17 with the rotating shaft 301 will not be described in detail herein. In this case, the stop pin 501 is stopped at either side rod 171.

Figure 18:
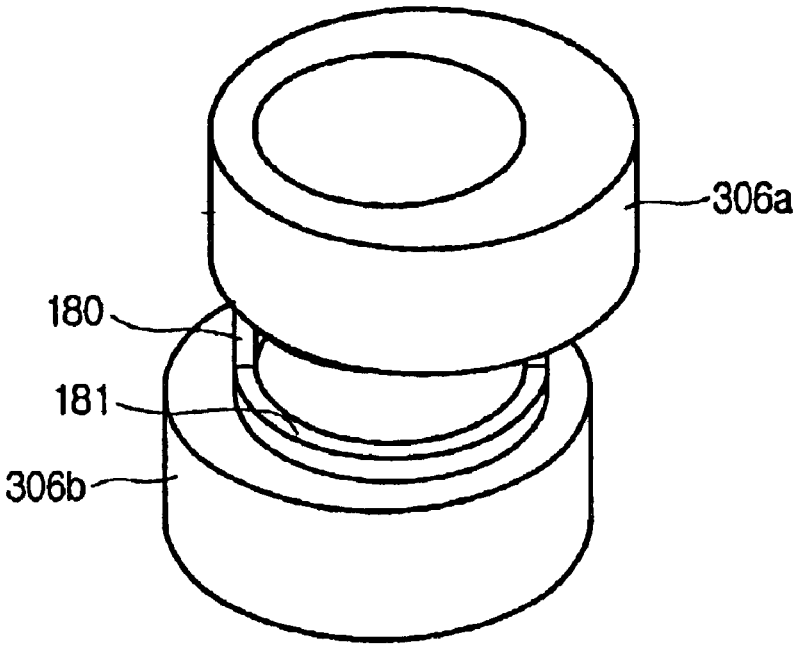
FIG. 18 is a perspective view showing first and second cam bushings according to still another embodiment of the present invention.
Figure 19:
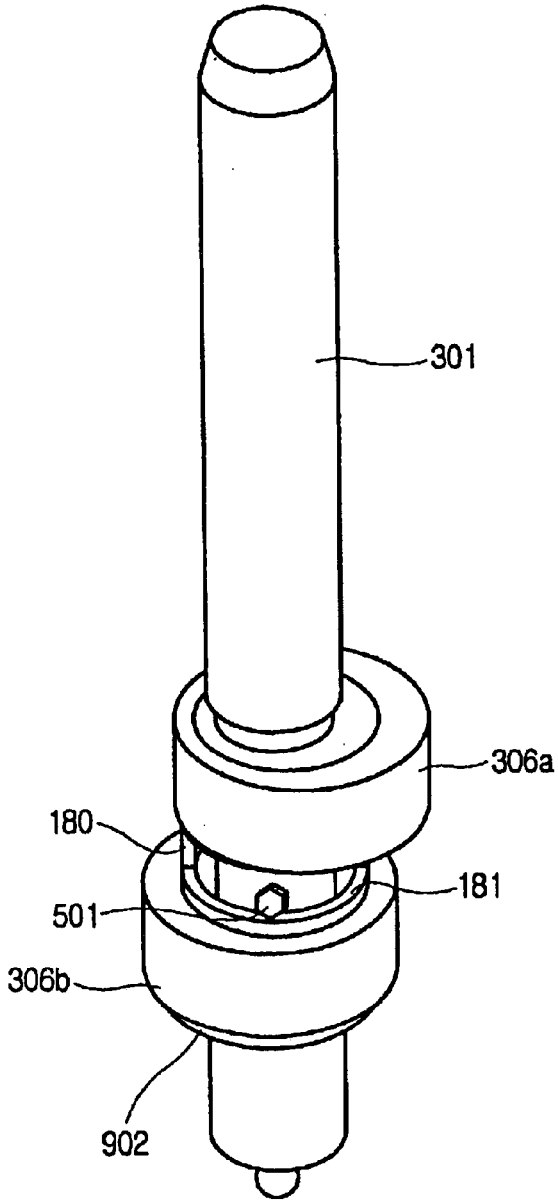
FIG. 19 is a perspective view showing the first and second cam bushings of FIG. 18 assembled with a rotating shaft.

FIG. 18 shows first and second cam bushings 306*a* and 306*b* according to still another embodiment of the present invention. In this case, the first and second cam bushings 306*a* and 306*b* are connected to each other by a cylindrical connecting part 180. A stop channel 181 is circumferentially formed along a part of the sidewall of the cylindrical connecting part 180. The first and second cam bushings 306*a* and 306*b* may be applied to the rotating shaft 301 shown in FIG. 12. A stop pin 501 which is screwed into the pin hole 901 of the rotating shaft 301 shown in FIG. 12 is stopped at either end of the stop channel 181. FIG. 19 shows the first and second cam bushings 306*a* and 306*b* of FIGS. 18 assembled with the rotating shaft 301 of FIG. 12. Since the eccentric directions of the first and second eccentric parts 301*a* and 301*b* provided on the rotating shaft 301 shown in FIG. 12 are equal to each other, the first and second cam bushings 306*a* and 306*b* shown in FIG. 18 are arranged in such a way that their eccentric directions are opposite to each other. In the case of the first and second cam bushings 306*a* and 306*b* which engage with each other by the toothed parts 150 and 151 of FIGS. 15A and 15B or are connected to each other by the rods 171 of FIG. 17 so as to be integrally rotated, the first and second cam bushings 306*a* and 306*b* are preferably arranged in such a way that their eccentric directions are opposite to each other within ±30° when assembling the compressor, so as to reduce the number of the weight balancers.

Figure 20:
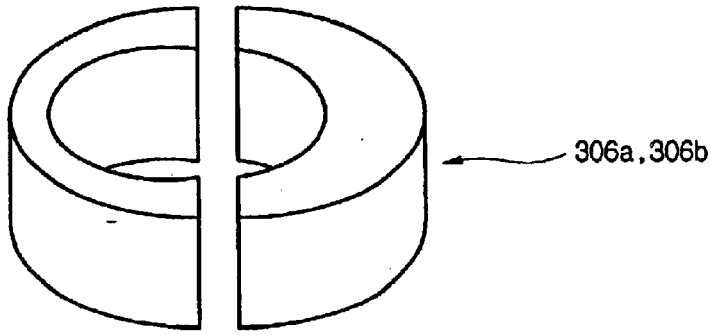
FIG. 20 is a perspective view showing one of first and second cam bushings according to still another embodiment of the present invention.
Figure 21:
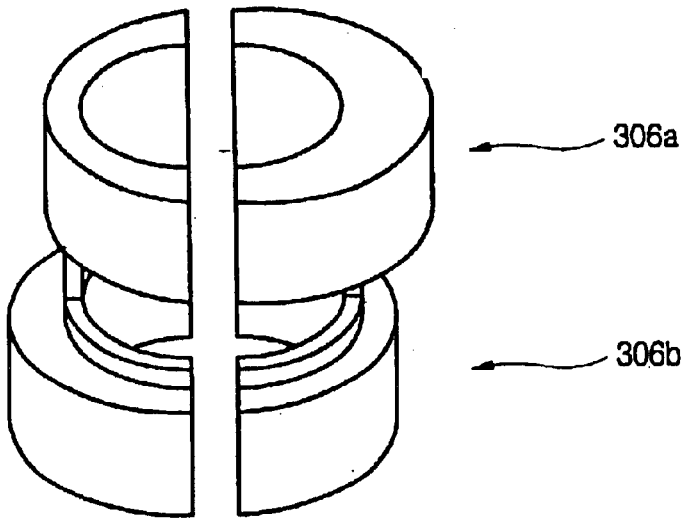
FIG. 21 is a perspective view showing first and second cam bushings according to still another embodiment of the present invention.

When assembling the first and second cam bushings 306*a* and 306*b* shown in FIGS. 15A, 15B, 17, and 18 with the rotating shafts 301 shown in FIGS. 9 through 12, the first and second bushings 306*a* and 306*b* must be axially fitted over each of the rotating shafts 301 in a direction from the top to the bottom of the rotating shaft 301, because the support step 902 is provided on the lower portion of the rotating shaft 301. In this case, the inner diameters of the first and second cam bushings 306*a* and 306*b* shown in FIGS. 15A, 15B, 17 and 18 must be equal to or larger than the outer diameter of each of the rotating shafts 301 shown in FIGS. 9 through 12, because the first and second eccentric parts 301*a* and 301*b* are inserted into the openings of the first and second cam bushings 306*a* and 306*b* in the first and second cylinders 307*a* and 307*b*, respectively. Of course, when the outer diameter of the first or second eccentric parts 301*a* or 301*b* is larger the diameter of the rotating shaft 301, the inner diameter of each of the first and second cam bushings 306*a* and 306*b* must be equal to or larger than the outer diameter of an associated one of the first and second eccentric parts 301*a* or 301*b*. In this case, the first cam bushing 306*a* is assembled with the rotating shaft 301 after assembling the second cam bushing 306*b* with the rotating shaft 301. Thus, in order to allow the first and second cam bushings 306*a* and 306*b* to be assembled with the rotating shaft 301, the outer diameter of the first cam bushing 306*a* must be smaller than or equal to the outer diameter of the second eccentric part 301*b* and the inner diameter of the first cam bushing 306*a* must be smaller than or equal to the inner diameter of the second cam bushing 306*b*. However, such an assembling method is problematic in that the first and second cam bushings 306*a* and 306*b* must be axially fitted over the rotating shaft 301. Thus, in order to allow the first and second cam bushings 306*a* and 306*b* to be more easily fitted over the rotating shaft 301, the first and second cam bushings 306*a* and 306*b* each may be axially divided into two pieces as shown in FIGS. 20 and 21.

Figure 22:
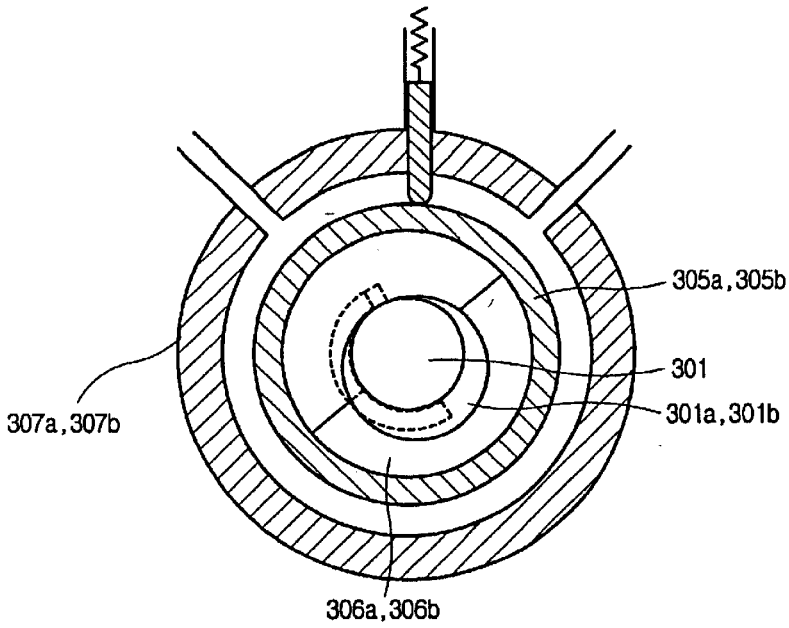
FIG. 22 is a sectional view showing one of the first and second cam bushings of FIG. 20 or 21 set in an associated cylinder.

FIG. 22 shows each of the first and second cam bushings 306*a* and 306*b* seated in an associated one of the first and second cylinders 307*a* and 307*b*. As such, the first and second cam bushings 306*a* and 306*b* each are axially divided into pieces, so the first and second cam bushings 306*a* and 306*b* do not need to be axially fitted over the rotating shaft 301.

Oil is supplied from the oil container 313, which is provided on the lower portion of the compressor, to components between which friction is created. Oil is smoothly supplied to the components as they are operated. As described above with reference to FIG. 4, when the first or second roller piston 305*a* or 305*b* performs an idle action, the first or second roller piston 305*a* or 305*b* is only slightly rotated due to a frictional force generated between each of the first and second roller pistons 305*a* or 305*b* and the outer surface of an associated one of the first and second cam bushings 306*a* or 306*b*. Due to a slight rotation of the roller piston 305*a* or 305*b*, oil may not be smoothly supplied between each of the first and second eccentric parts 301*a* and 301*b* and an associated one of the first and second cam bushings 306*a* and 306*b*, and between each of the first and second cam bushings 306*a* and 306*b* and an associated one of the first and second roller pistons 305*a* and 305*b*. Thus, in order to smoothly supply oil to the components of the compressor even when performing an idle action, the first and second roller pistons 305*a* and 305*b* must be slightly and eccentrically rotated even when performing such an idle action. As such, in order to allow the first and second roller pistons 305*a* and 305*b* to be eccentrically rotated even when performing an idle action, the positions of the first and second locking steps 502 and 702, the stop channel 181, the toothed parts 150 and 151, the rod assembly and the stop pins 501 and 502 may be changed. Alternatively, the above-mentioned eccentric rotation of the first and second roller pistons 305*a* and 305*b* during an idle action may be accomplished by changing the eccentricities of the first and second eccentric parts 301*a* and 301*b* and the first and second cam bushings 306*a* and 306*b*. Thus, when changing the positions of the above-mentioned components, each of the first and second roller pistons 305*a* and 305*b* is eccentrically rotated to a predetermined extent even when performing an idle action.

However, there may occur unexpected problems due to a difference in pressure between a cylinder performing a compressing action and a cylinder performing an idle action. Such a case will be described in the following with reference to FIG. 23.

For easy description, it is assumed that an idle action is performed in the upper or first cylinder 307*a* and a compressing action is performed in the lower or second cylinder 307*b*.

Figure 23:
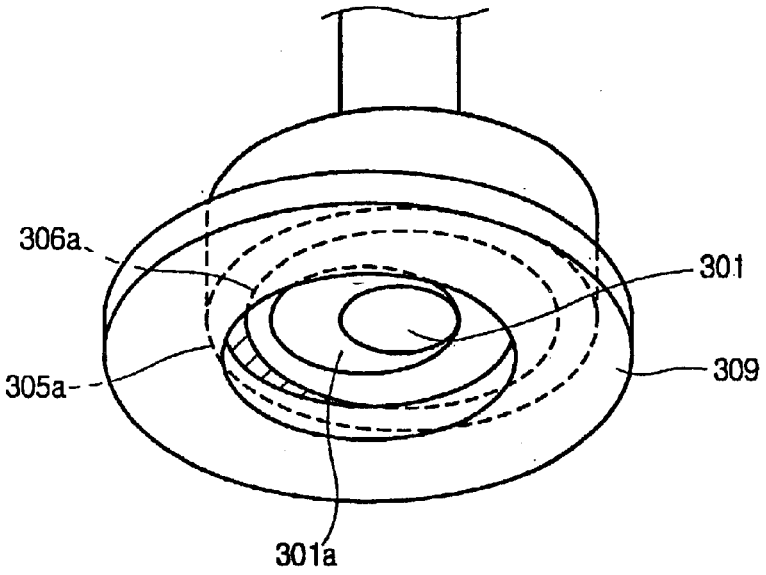
FIG. 23 is a perspective view showing a possible problem of the first and second roller pistons.
Figure 24:
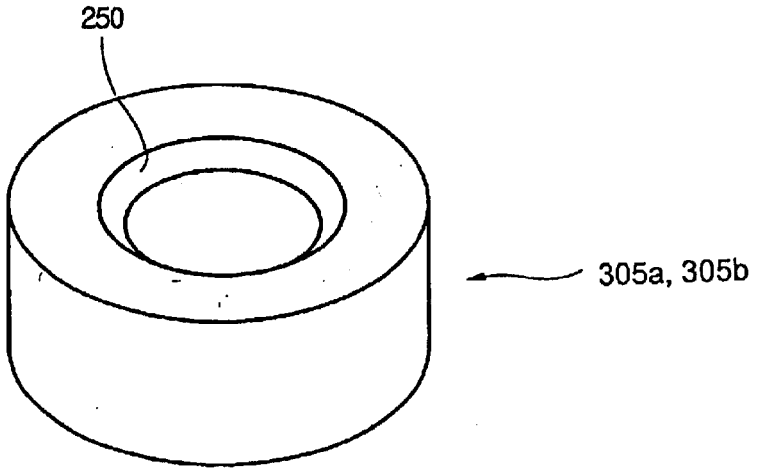
FIG. 24 is a perspective view showing the first or second roller pistons having a relief formed on an inner diameter thereof according to the present invention.
Figure 25:
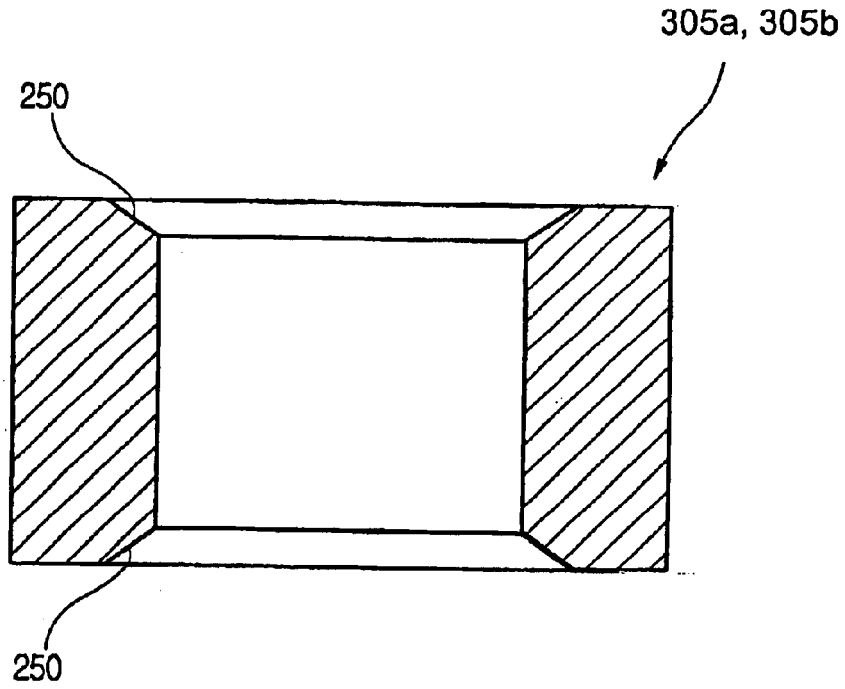
FIG. 25 is a sectional view showing the first or second roller pistons having a relief formed on an inner diameter thereof according to the present invention.
Figure 26:
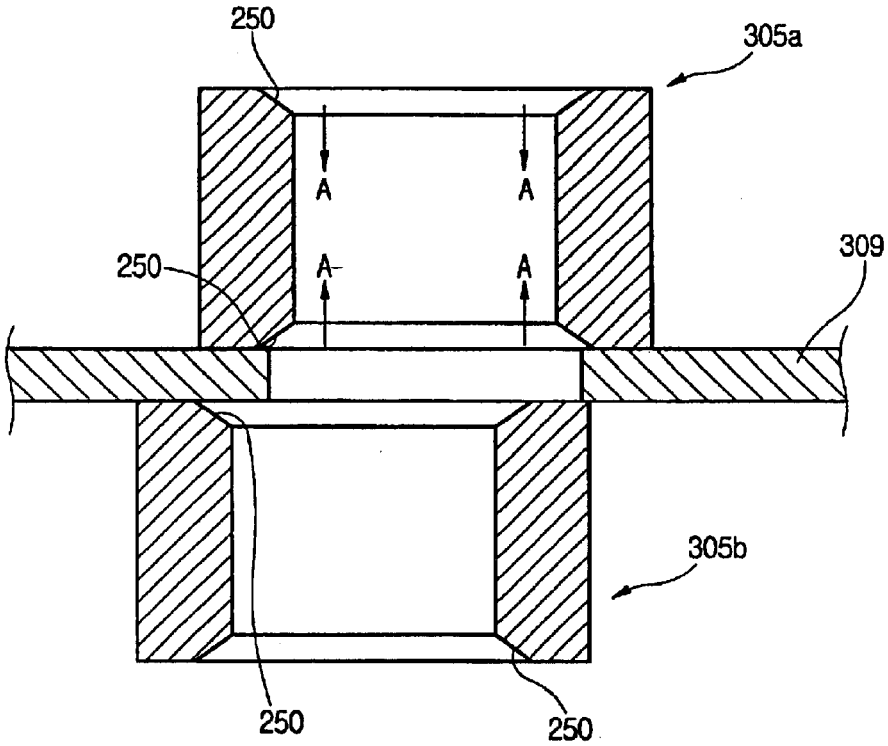
FIG. 26 is a view showing the operational effect of the first and second roller pistons having the reliefs shown in FIGS. 24 and 25.

As shown by the oblique lines of FIG. 23, any point on a horizontal surface of the front roller piston 305*a*, which is in contact with the middle plate 309, may be exposed to a central opening of the middle plate 309 which hermetically separates the compression chamber of the first cylinder 307*a* from the compression chamber of the second cylinder 307*b*, because the lower surface of the first roller piston 305*a* is eccentrically rotated to a predetermined extent even when the idle action is performed in the first cylinder 307*a*. In this case, a part of refrigerant compressed in the second cylinder 307*b* enters the central opening of the middle plate 309, and upwardly pushes the first roller piston 305*a*. At this time, the first roller piston 305*a* is in contact with the upper flange 310, so the rotating efficiency of the rotating shaft 301 is reduced, especially if oil is not smoothly supplied to the components. In order to solve such a problem, each of the first and second roller pistons 305*a* and 305*b* has a relief 250 formed along upper and lower edges of the inner surface thereof. FIGS. 24 and 25 are a perspective view and a sectional view showing each of the first and second roller pistons 305*a* and 305*b* having the relief 250. As shown in the FIGS. 24–26, the relief 250 of each of the first and second roller pistons 305*a* and 305*b* is chamfered. The upper and lower reliefs 250 may be symmetrically formed. The relief 250 may be in a form other than a chamfered form. For example, each relief 250 may have a rectangular multi-stepped cross-section.

The effect of the relief 250 will be described with reference to FIG. 25. When a compressing action is performed in the first cylinder 307*a*, a small quantity of high-pressure refrigerant gas generated by the compressing action remains in the upper and lower reliefs 250 of the roller piston 305*a*. Subsequently, when another compressing action is performed in the second cylinder 307*b* by changing the rotating direction of the rotating shaft 301, high-pressure refrigerant gas generated by the other compressing action enters the central opening of the middle plate 309 and upwardly pushes the first roller piston 305*a* with a pressure "A." At this time, the high-pressure gas remaining in the upper relief 250 of the first roller piston 305*a* downwardly pushes the first roller piston 305*a* with a pressure "A" of the same magnitude. That is, pressure "A" of the same magnitude is simultaneously applied to the first roller piston 305*a* in opposite directions. Thus, such an action of the pressure prevents rotating efficiency of the rotating shaft 301 from being reduced, and allows oil to be smoothly supplied to several components of the compressor, even when the first roller piston 305*a* is in contact with the upper flange 310. Preferably, each of the reliefs 250 is formed in such a way that any point on a horizontal surface of the first or second roller piston 305*a* or 305*b*, which is in contact with the disc-shaped middle plate 309, is not exposed to the central opening of the middle plate 309 when the first or second roller piston 305*a* or 305*b* is eccentrically rotated to a predetermined extent during an idle action of the first or second roller piston 305*a* or 305*b*, thus maintaining a pressure balance between the high-pressure refrigerant gas received in the upper and lower cut parts 250. A depth of each of the reliefs 250 may be determined according to a centrifugal force and an inertia moment generated in an associated one of the first and second cylinders 307*a* and 307*b*, so as to reduce the vibration and noise of the compressor. The reliefs 250 are not necessarily required for the case where the first or second roller piston 305*a* or 305*b* is eccentrically rotated, even when performing an idle action. That is, the reliefs 250 are required for the case where any point on a horizontal surface of the first or second roller piston 305*a* or 305*b*, which is in contact with the disc-shaped middle plate 309, is not exposed to the central opening of the middle plate 309.

As is apparent from the above description, the present invention provides a rotary compressor, which varies a compression capacity of the rotary compressor as desired without using an expensive inverter circuit and a control board to control the inverter circuit, which inverter circuit and control board are used to vary the compression capacity in a conventional rotary compressor. Thus, production cost of the compressor and the operating cost of the compressor due to the reduced power consumption are reduced as compared with the conventional compressor.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A rotary compressor, comprising:

a plurality of cylinders;

a rotating shaft provided with a plurality of eccentric parts which are eccentrically rotated in compression chambers defined in the cylinders;

a plurality of roller pistons rotationally coupled with the eccentric parts and which compress refrigerant in the compression chambers;

a reversible motor which rotates the shaft in selectively opposite directions; and a clutch which clutches the roller pistons such that the roller pistons perform a compressing action or an idle action according to a rotating direction of the rotating shaft, thus varying a compression capacity of the compressor according to the rotating direction of the rotating shaft.

2. The rotary compressor as set forth in claim 1, wherein the cylinders comprise first and second cylinders arranged at upper and lower positions, respectively, and having different compression capacities, with first and second eccentric parts provided in the first and second cylinders, respectively, and first and second roller pistons provided in the first and second cylinders, respectively.

3. The rotary compressor as set forth in claim 2, wherein the clutch comprises:

first and second cam bushings having a cylindrical shape and provided between the first eccentric part and the first roller piston and between the second eccentric part and the second roller piston, respectively, and being eccentric in a radial direction; and an eccentricity control unit which controls the first and second cam bushings such that eccentric directions of the first and second cam bushings are equal to or opposite to eccentric directions of the first and second eccentric parts when the rotating direction of the rotating shaft is changed, thus controlling the first and second roller pistons to selectively perform compressing actions thereof.

4. The rotary compressor as set forth in claim 3, wherein the eccentricity control unit comprises:

first and second stop pins provided on the rotating shaft to be rotated along with the rotating shaft; and a stopper which limits a slidable rotating range of each of the first and second stop pins with respect to an associated one of the first and second cam bushings within a predetermined angular range when the rotating direction of the rotating shaft is changed.

5. The rotary compressor as set forth in claim 4, wherein:

the stopper comprises arc-shaped first and second locking steps, the first locking step being downwardly projected from a lower surface of the first cam bushing and the second locking step being upwardly projected from an upper surface of the second cam bushing; and the first and second stop pins are provided on the rotating shaft in such a way as to be perpendicular to the rotating shaft such that each of the first and second stop pins is stopped at either end of an associated one of the first and second locking steps according to a rotating direction of the rotating shaft.

6. The rotary compressor as set forth in claim 3, wherein the first and second cam bushings engage with each other by toothed parts provided on the first and second cam bushings, such that the first and second cam bushings are rotated together when the rotating shaft is rotated.

7. The rotary compressor as set forth in claim 6, wherein the toothed parts comprise:

an arc-shaped downward toothed part provided on a lower surface of the first cam bushing; and an arc-shaped upward toothed part provided on an upper surface of the second cam bushing, and engaging with the downward toothed part.

8. The rotary compressor as set forth in claim 7, wherein the eccentricity control unit comprises a stop pin provided on the rotating shaft, the stop pin perpendicularly engaged with the rotating shaft, rotating along with the rotating shaft, and alternatively stopped at first and second ends of the engaged toothed parts, to limit a slidable rotating range of the rotating shaft with respect to the first and second cam bushings within a predetermined angular range.

9. The rotary compressor as set forth in claim 3, wherein the first and second cam bushings are connected to each other by a rod assembly comprising at least one rod, such that the first and second cam bushings are rotated together with the rotating shaft.

10. The rotary compressor as set forth in claim 9, wherein at least one rod hole is formed on a lower surface of the first cam bushing and on an upper surface of the second cam bushing at a position corresponding to the rod hole formed on the first cam bushing, respectively, and both ends of the rod are inserted into the rod holes formed on the first and second cam bushings so as to connect the first and second cam bushings to each other.

11. The rotary compressor as set forth in claim 10, wherein the eccentricity control unit comprises a stop pin provided on the rotating shaft, the stop pin perpendicularly engaged with the rotating shaft, rotating along with the rotating shaft, and alternatively stopped at first and second sides of the rod assembly, to limit a slidable rotating range of the rotating shaft with respect to the first and second cam bushings within a predetermined angular range.

12. The rotary compressor as set forth in claim 3, wherein the first and second cam bushings are connected to each other by a cylindrical connecting part such that the first and second cam bushings are rotated together when the rotating shaft is rotated.

13. The rotary compressor as set forth in claim 12, wherein the eccentricity control unit comprises:

a stop channel circumferentially formed along a part of a sidewall of the cylindrical connecting part; and a stop pin provided on the rotating shaft the stop pin perpendicularly engaged with the rotating shaft, rotating along with the rotating shaft, and alternatively stopped at first and second ends of the stop channel, to limit a slidable rotating range of the rotating shaft with respect to the first and second cam bushings within a predetermined angular range.

14. The rotary compressor as set forth in claim 5, wherein the rotating shaft is provided with a plurality of pin holes and each stop pin is inserted into a respective one of the pin holes.

15. The rotary compressor as set forth in 8, wherein the rotating shaft is provided with a pin hole and the stop pin is inserted into the pin hole.

16. The rotary compressor as set forth in 11, wherein the rotating shaft is provided with a pin hole and the stop pin is inserted into the pin hole.

17. The rotary compressor as set forth in 13, wherein the rotating shaft is provided with a pin hole and the stop pin is inserted into the pin hole.

18. The rotary compressor as set forth in claim 14, wherein an internal threaded part is formed on an inner surface of each pin hole and an external threaded part is formed on an outer surface of each stop pin, thus allowing the stop pins to be screwed into the respective ones of the pin holes.

19. The rotary compressor as set forth in claim 15, wherein an internal threaded part is formed on an inner surface of the pin hole and an external threaded part is formed on an outer surface of the stop pin, thus allowing the stop pin to be screwed into the pin hole.

20. The rotary compressor as set forth in claim 16, wherein an internal threaded part is formed on an inner surface of the pin hole and an external threaded part is formed on an outer surface of the stop pin, thus allowing the stop pin to be screwed into the pin hole.

21. The rotary compressor as set forth in claim 17, wherein an internal threaded part is formed on an inner surface of the pin hole and an external threaded part is formed on an outer surface of the stop pin, thus allowing the stop pin to be screwed into the pin hole.

22. The rotary compressor as set forth in claim 3, wherein the eccentricity of each of the first and second eccentric parts or each of the first and second cam bushings is determined to allow an associated one of the first and second roller pistons to be eccentrically rotated to a predetermined extent during the idle action of the associated roller piston.

23. The rotary compressor as set forth in claim 3, wherein the eccentricity control unit allows each of the first and second roller pistons to eccentrically rotate to a predetermined extent during an idle action of the first or second roller piston.

24. The rotary compressor as set forth in claim 16, wherein each of the first and second roller pistons is provided with a relief along respective upper and lower edges of an inner surface of each of the first and second roller pistons.

25. The rotary compressor as set forth in claim 17, wherein each of the first and second roller pistons is provided with a relief along respective upper and lower edges of an inner surface of each of the first and second roller pistons.

26. The rotary compressor as set forth in claim 24, wherein the reliefs provided along the respective upper and lower edges of the inner surface are symmetrically formed.

27. The rotary compressor as set forth in claim 25, wherein the reliefs provided along the respective upper and lower edges of the inner surface are symmetrically formed.

28. The rotary compressor as set forth in claim 24, further comprising:

a disc-shaped middle plate hermetically separating the first and second cylinders from each other and having a central opening;

wherein each of the reliefs has one of a diagonal cross-section and a rectangular multi-stepped cross-section, and each relief is formed so that any point on a horizontal surface of the first or second roller piston, which point is in contact with the disc-shaped middle plate, is not exposed to the central opening of the middle plate when the first or second roller piston is eccentrically rotated by a predetermined extent during an idle action of the first or second roller piston.

29. The rotary compressor as set forth in claim 25, further comprising:

a disc-shaped middle plate hermetically separating the first and second cylinders from each other and having a central opening, wherein each of the reliefs has one of a diagonal cross-section and a rectangular multi-stepped cross-section, and each relief is formed so that any point on a horizontal surface of the first or second roller piston, which point is in contact with the disc-shaped middle plate, is not exposed to the central opening of the middle plate when the first or second roller piston is eccentrically rotated by a predetermined extent during an idle action of the first or second roller piston.

30. The rotary compressor as set forth in claim 24 wherein a depth of each relief is determined according to a difference between a centrifugal force and an inertia moment generated in an associated one of the first and second cylinders.

31. The rotary compressor as set forth in claim 25, wherein a depth of each relief is determined according to a difference between a centrifugal force and an inertia moment generated in an associated one of the first and second cylinders.

32. The rotary compressor as set forth in claim 6, wherein an eccentric direction of the first cam bushing is opposite to an eccentric direction of the second cam bushing within a predetermined angular range.

33. The rotary compressor as set forth in claim 9, wherein an eccentric direction of the first cam bushing is opposite to an eccentric direction of the second cam bushing within a predetermined angular range.

34. The rotary compressor as set forth in claim 12, wherein an eccentric direction of the first cam bushing is opposite to an eccentric direction of the second cam bushing within a predetermined angular range.

35. The rotary compressor as set forth in claim 32, wherein the predetermined angular range is limited within ±30°.

36. The rotary compressor as set forth in claim 33, wherein the predetermined angular range is limited within ±30°.

37. The rotary compressor as set forth in claim 34, wherein the predetermined angular range is limited within ±30°.

38. The rotary compressor as set forth in claim 3, wherein the rotating shaft is provided at a predetermined position under the second eccentric part with a support step so as to upwardly support the second cam bushing and downwardly support a lower flange supporting the rotating shaft.

39. The rotary compressor as set forth in claim 3, wherein an inner diameter of each of the first and second cam bushings is equal to or larger than an outer diameter of the rotating shaft, thus allowing the first and second cam bushings to be axially fitted over the rotating shaft connected to the reversible motor when assembling the compressor.

40. The rotary compressor as set forth in claim 1, wherein each of the first and second roller pistons is provided with a relief along respective upper and lower edges of an inner surface of each of the first and second roller pistons.

41. The rotary compressor as set forth in claim 40, wherein the upper and lower reliefs are symmetrically formed.

42. The rotary compressor as set forth in claim 26, wherein each of the reliefs has one a diagonal cross-section and a rectangular multi-stepped cross-section, and each relief is formed so that any point on a horizontal surface of the first or second roller piston, which point is in contact with a disc-shaped middle plate hermetically separating the first and second cylinders from each other, is not exposed to a central opening of the middle plate during an idle action of the first or second roller piston.

43. The rotary compressor as set forth in claim 40, wherein a depth of each relief is determined according to a centrifugal force and an inertia moment generated in an associated one of the first and second cylinders.

44. The rotary compressor as set forth in claim 3, wherein an outer diameter of the first eccentric part is smaller than or equal to an outer diameter of the second eccentric part, and an inner diameter of the first cam bushing is smaller than or equal to an inner diameter of the second cam bushing.

45. The rotary compressor as set forth in claim 3, wherein each of the first and second cam bushings is axially divided into pieces, thus allowing the first and second cam bushings to be inserted and seated into openings of the first and second roller pistons, respectively, when assembling the compressor.

46. The rotary compressor as set forth in claim 1, wherein the eccentric parts of the rotating shaft have the same eccentric direction.

47. The rotary compressor as set forth in claim 1, wherein respective outer diameters of the eccentric parts are equal.

48. The rotary compressor as set forth in claim 2, wherein the first cylinder has a larger compression capacity than a compression capacity of the second cylinder.

49. The rotary compressor as set forth in claim 48, wherein a ratio of the compression capacity of the first cylinder to the compression capacity of the second cylinder is 10:4.

50. The rotary compressor as set forth in claim 2, wherein a compression capacity of the first cylinder is not equal to a compression capacity of the second cylinder.

51. A variable output compressor, comprising:

a plurality of compression chambers;

a plurality of roller pistons, each roller piston disposed in a respective one of the plurality of compression chambers and adapted to be eccentrically driven;

an eccentric drive system which:

drives at least one of the plurality of roller pistons to compress a gas at a first compression ratio in one of the plurality of compression chambers, where the at least one of the roller pistons is being driven in a first angular direction; and drives at least one other of the plurality of roller pistons to compress the gas at a second compression ratio in another of the plurality of compression chambers, where the at least one other of the roller pistons is being driven in a second angular direction.

52. The rotary compressor as set forth in claim 51, wherein the eccentric drive system:

drives the at least one of the plurality of roller pistons to compress the gas at a third compression ratio in the one of the plurality of compression chambers, where the at least one of the plurality of roller pistons is being driven in the second angular direction; and drives the at least one other of the plurality of roller pistons to compress the gas at a fourth compression ratio in the another of the plurality of compression chambers, where the at least one other of the plurality of roller pistons is being driven in the first angular direction.

53. The rotary compressor as set forth in claim 52, wherein one of the first and third compression ratios is zero.

54. The rotary compressor as set forth in claim 52, wherein one of the second and fourth compression ratios is zero.

55. The rotary compressor as set forth in claim 51, wherein a ratio of the first compression ratio to the second compression ratio is about 10:4.

56. The rotary compressor as set forth in claim 51, wherein a ratio of the first compression ratio to the second compression ratio is about 4:10.

57. The rotary compressor as set forth in claim 51, wherein the first and second compression ratios are equal.

58. The rotary compressor as set forth in claim 52, wherein the third and fourth compression ratios are equal.

59. The rotary compressor as set forth in claim 53, wherein the first and second angular directions are determined by a reversible motor.

* * * * *

UNITED STATES PATENT AND TRADEMARK OFFICE

CERTIFICATE OF CORRECTION

PATENT NO. : 6,860,724 B2
DATED : March 1, 2005
INVENTOR(S) : Sung-Hea Cho et al.

It is certified that error appears in the above-identified patent and that said Letters Patent is hereby corrected as shown below:

Column 1,
Line 36, delete “be” (first occurrence).

Column 9,
Line 61, change “ad” to -- and --.

Column 10,
Line 10, change “FIGS.” to -- FIG. --.

Column 14,
Lines 55, 58 and 61, after “in” insert -- claim --.

Column 16,
Line 4, after “24” insert -- , (comma) --.
Line 53, change “one a diagonal” to -- a diagonal --.

Signed and Sealed this

Twenty-first Day of March, 2006

JON W. DUDAS
*Director of the United States Patent and Trademark Office*